US010478787B1

(12) United States Patent
Hellbusch et al.

(10) Patent No.: US 10,478,787 B1
(45) Date of Patent: Nov. 19, 2019

(54) SALT BRINE PRODUCTION SYSTEM

(71) Applicants: James A. Hellbusch, Columbus, NE (US); John Cappello, Omaha, NE (US)

(72) Inventors: James A. Hellbusch, Columbus, NE (US); John Cappello, Omaha, NE (US)

(73) Assignee: DUO LIFT MANUFACTURING CO., INC., Columbus, NE (US)

( * ) Notice: Subject to any disclaimer, the term of this patent is extended or adjusted under 35 U.S.C. 154(b) by 0 days.

(21) Appl. No.: 16/530,296

(22) Filed: Aug. 2, 2019

Related U.S. Application Data

(62) Division of application No. 16/393,284, filed on Apr. 24, 2019.

(51) Int. Cl.
*B01F 1/00* (2006.01)
*B01F 15/02* (2006.01)

(52) U.S. Cl.
CPC ..... *B01F 1/0038* (2013.01); *B01F 1/0033* (2013.01); *B01F 15/0254* (2013.01); *B01F 15/0277* (2013.01); *B01F 2001/0088* (2013.01); *B01F 2215/008* (2013.01)

(58) Field of Classification Search
CPC ..... B01F 1/0038
USPC ..... 422/274, 276–278
See application file for complete search history.

(56) References Cited

U.S. PATENT DOCUMENTS 2,502,726 A * 4/1950 Horton ..... E03F 5/26 422/274
2,663,563 A * 12/1953 Watson ..... F16F 1/20 267/49
3,363,995 A * 1/1968 Driskell ..... B01F 1/0005 423/179
3,383,178 A * 5/1968 Dietz ..... C02F 1/688 422/278
3,684,457 A * 8/1972 Pinto et al. ..... B01F 1/0033 422/274
4,379,125 A * 4/1983 Benninger ..... B01F 1/0016 210/540
7,186,390 B1 * 3/2007 Hellbusch ..... B01F 1/0022 406/137
7,810,987 B2 * 10/2010 Hildreth ..... B01F 1/0016 366/136
8,529,845 B2 * 9/2013 Kois ..... B01F 1/0027 222/180
9,441,339 B2 * 9/2016 Kois ..... B01F 15/00785

* cited by examiner

*Primary Examiner* — David L Sorkin

(74) *Attorney, Agent, or Firm* — Dennis L. Thomte; Thomte Patent Law Office LLC

(57) ABSTRACT

A brine maker including a hopper having an open upper end and an open lower end with the hopper being configured to receive salt therein. A solids screen is positioned at the lower end of the hopper. A receiving tank having an open upper end is positioned below the solids screen. An overflow tube is positioned in the hopper and has an upper end positioned below the upper end of the hopper. When the level of salt brine reaches the upper end of the overflow tube, the salt brine will overflow into the overflow tube and will pass downward therethrough the solids screen and into the receiving tank. The invention includes a second embodiment wherein an overflow panel with an upper end is positioned in the hopper thereby creating a passageway into which brine overflow may pass thereinto and pass through the solids screen into the receiving tank.

5 Claims, 10 Drawing Sheets

SALT BRINE PRODUCTION SYSTEM

CROSS REFERENCE TO RELATED APPLICATION

This is a Divisional Application of application Ser. No. 16/393,284 filed Apr. 24, 2019, entitled SALT BRINE PRODUCTION SYSTEM.

BACKGROUND OF THE INVENTION

Field of the Invention

This system relates to a salt brine production system, also known as a brine maker. Even more particularly, this invention relates to upward/overflow devices positioned in the salt hopper of the brine maker thereby providing a salt brine production system with simultaneous downward flow and internal upward/overflow brine production.

Description of the Related Art

Current salt brine production systems for making liquid salt brine solutions use either a downward flow design or an upward flow design. An example of a downward flow brine maker is Model No. BPS3000-SS manufactured by Duo Lift Manufacturing Co., Inc., marketed by Dultmeier Sales of Omaha, Nebr., where the salt brine flows downwardly through the salt bed in the salt hopper and through a solids screen at the bottom of the salt hopper and into a receiving tank. The BPS3000-SS of Dultmeier Sales is shown and described in U.S. Pat. No. 7,186,390 which has been assigned to Duo Lift Manufacturing Co., Inc. of Columbus, Nebr. An example of an upward flow design brine maker is the Varitech Industries Model HCSB1-400-SS.

If the salt which is utilized in a downward flow brine maker has a fine gradation, the fine particles of the salt tend to form a paste which slows down the flow of brine downwardly therethrough thereby decreasing the brine production rate. As the downward flow of brine is restricted, the level of the brine within the hopper tank will move upwardly. When the level of the brine within the hopper approaches the upper open end of the hopper, the water supply to the hopper must be reduced to prevent the brine from flowing over the upper end of the hopper which would decrease the production of brine. The same is also true for the upward flow brine production systems. The fine particles of salt also tend to clog the screen at the lower end of the salt hopper thereby decreasing the flow of brine through the screen. Further, the clogging of the screen requires that the system requires that the system be cleaned.

Upward flow brine production systems also experience similar problems thereby decreasing the rate of salt brine production.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The salt brine production system of the present invention includes a hopper having an open upper end, an open lower end, a front wall, a back wall, a first end wall and a second wall. The hopper is configured to receive salt therein. A receiving tank is positioned below the lower end of the hopper. The open lower end of the hopper is in communication with the open upper end of the receiving tank. The hopper includes at least one spray device mounted therein which is configured to spray water onto the salt in the hopper. A solids screen, having upper and lower surfaces, is positioned between the open lower end of the hopper and the open upper end of the receiving tank.

In the first embodiment of the present invention, a vertically disposed overflow tube, having an open upper end and a lower open end, is positioned in the hopper and is secured thereto. The open lower end of the overflow tube is in fluid communication with the solids screen. The open upper end of the overflow tube is spaced below the open upper end of the hopper. A screen is mounted on the open upper end of the overflow tube. The overflow tube is configured to permit the downward flow of salt brine therethrough to the solids screen and the receiving tank when the level of salt brine in the hopper reaches the screen.

In the second embodiment, an upstanding overflow wall member, having an upper end, a lower end, a first end and a second end, is positioned inwardly of the front wall of the hopper and is spaced therefrom. The first end of the overflow wall member is secured to the inner surface of the first end wall of the hopper. The second end of the overflow wall member is secured to the inner surface of the second end wall of the hopper. The upper end of the overflow wall member is positioned below the upper ends of the front wall, back wall, first end wall and second end wall. The lower end of the overflow wall member is positioned at the upper surface of the solids screen. A screen is positioned on the upper end of the overflow wall member which extends between the upper end of the overflow wall member to the first end wall, the front wall and a second end wall. The spacing of the overflow wall member from the first wall defines an overflow passageway, whereby salt brine in the hopper will overflow into the overflow passageway when the level of brine in the hopper reaches the upper end of the overflow wall member so that the overflow of salt brine into the overflow passageway will be directed onto the solids screen and then sent to the receiving tank.

It is therefore a principal object of the invention to provide an improved salt brine production system.

A further object of the invention is to provide a salt brine production system of the downward and upward flow type brine maker.

A further object of the invention is to provide a salt brine production system which includes a vertically disposed overflow tube in the hopper which enables the downward flow of salt brine therethrough to the lower end of the hopper.

A further object of the invention is to provide a salt brine production system which includes an upstanding overflow wall member positioned in the hopper which defines a passageway so that the salt brine in the hopper will overflow into the overflow passageway when the level of brine in the hopper reaches the upper end of the overflow wall member.

A further object of the invention is to be able to convert a downward flow brine maker into an upward/overflow brine maker.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
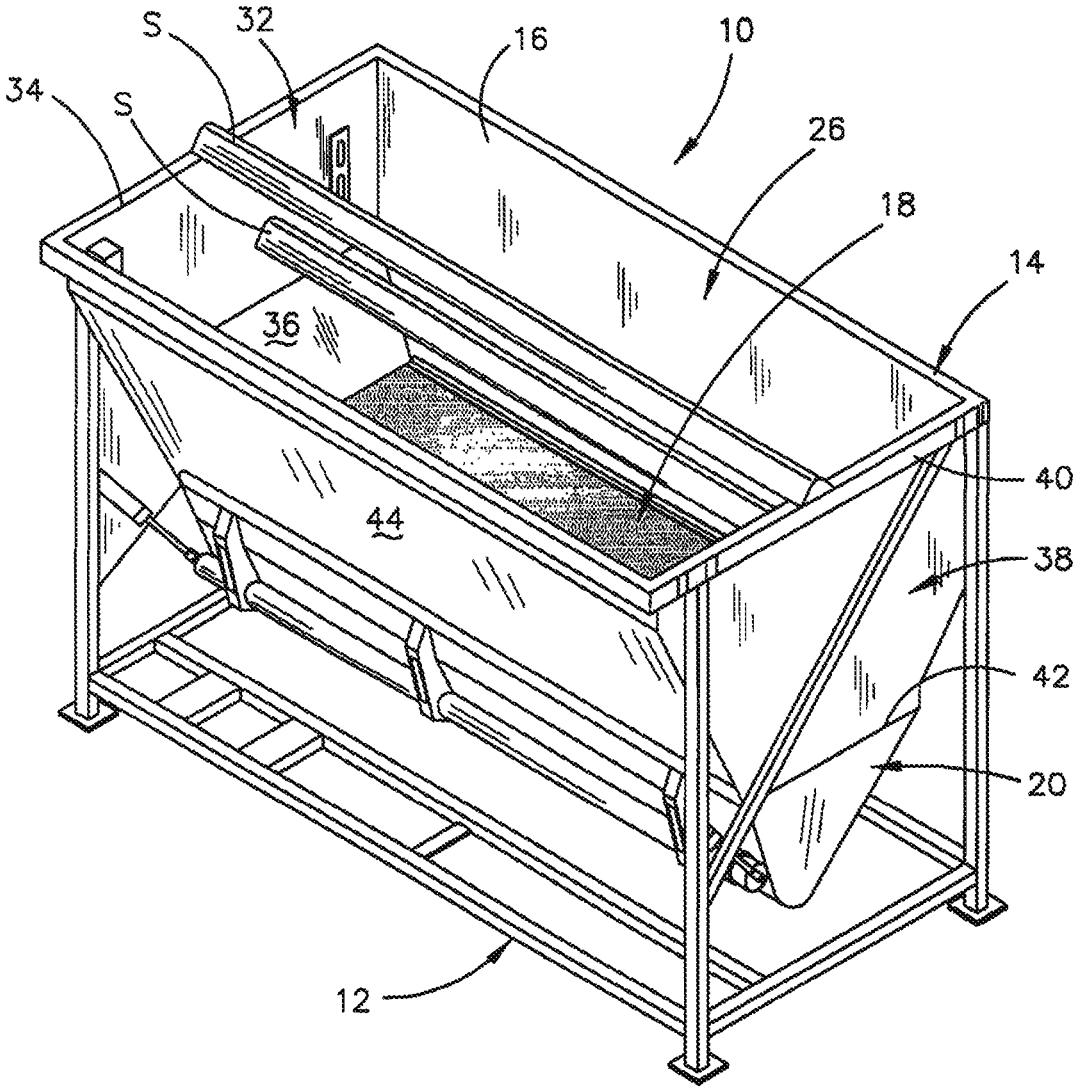
FIG. 1 (PRIOR ART)
FIG. 1 is a perspective view of a prior art salt brine production system.
Figure 2:
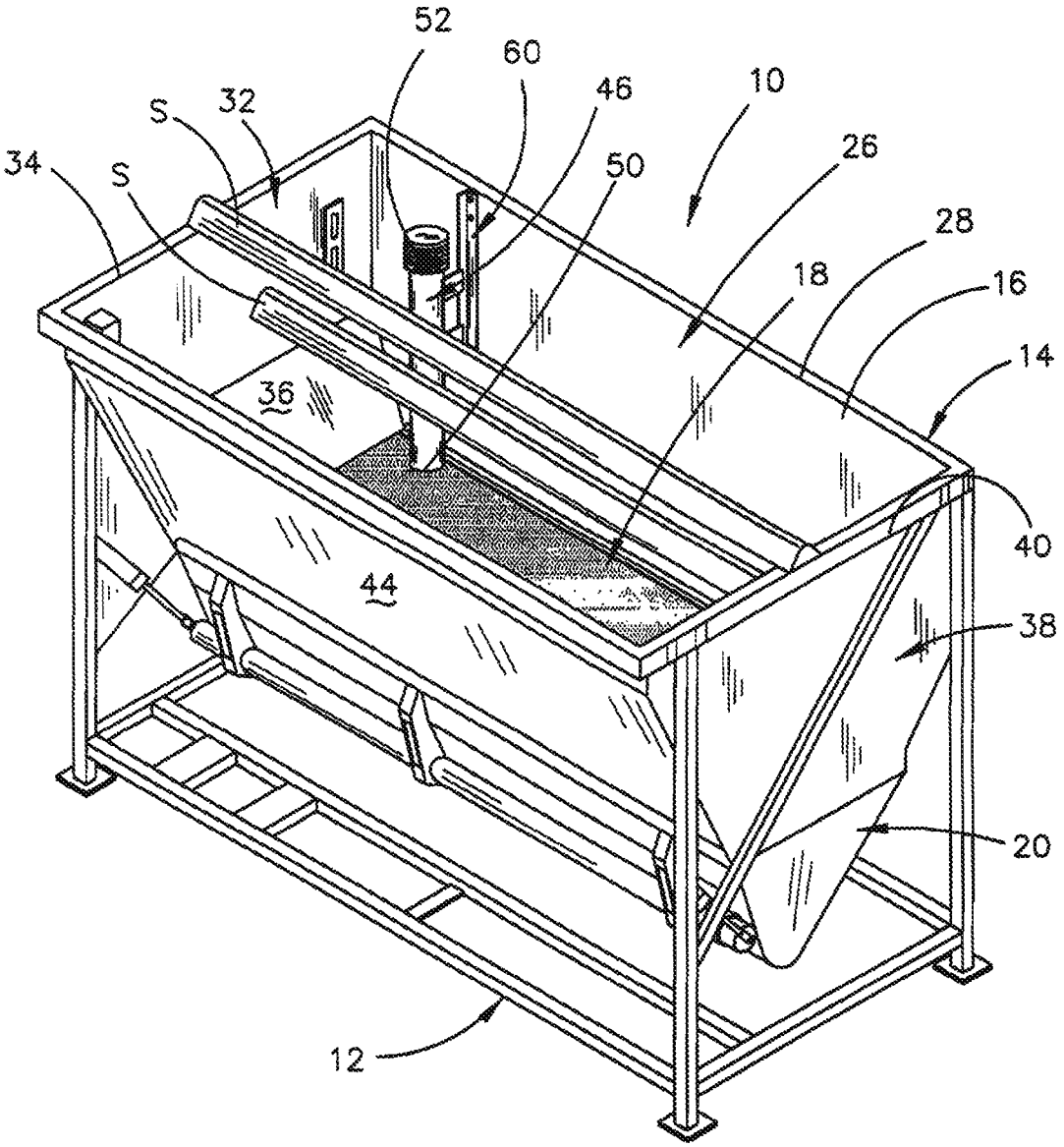
FIG. 2 is a perspective view of the first embodiment of the salt brine production system of this invention.
Figure 3:
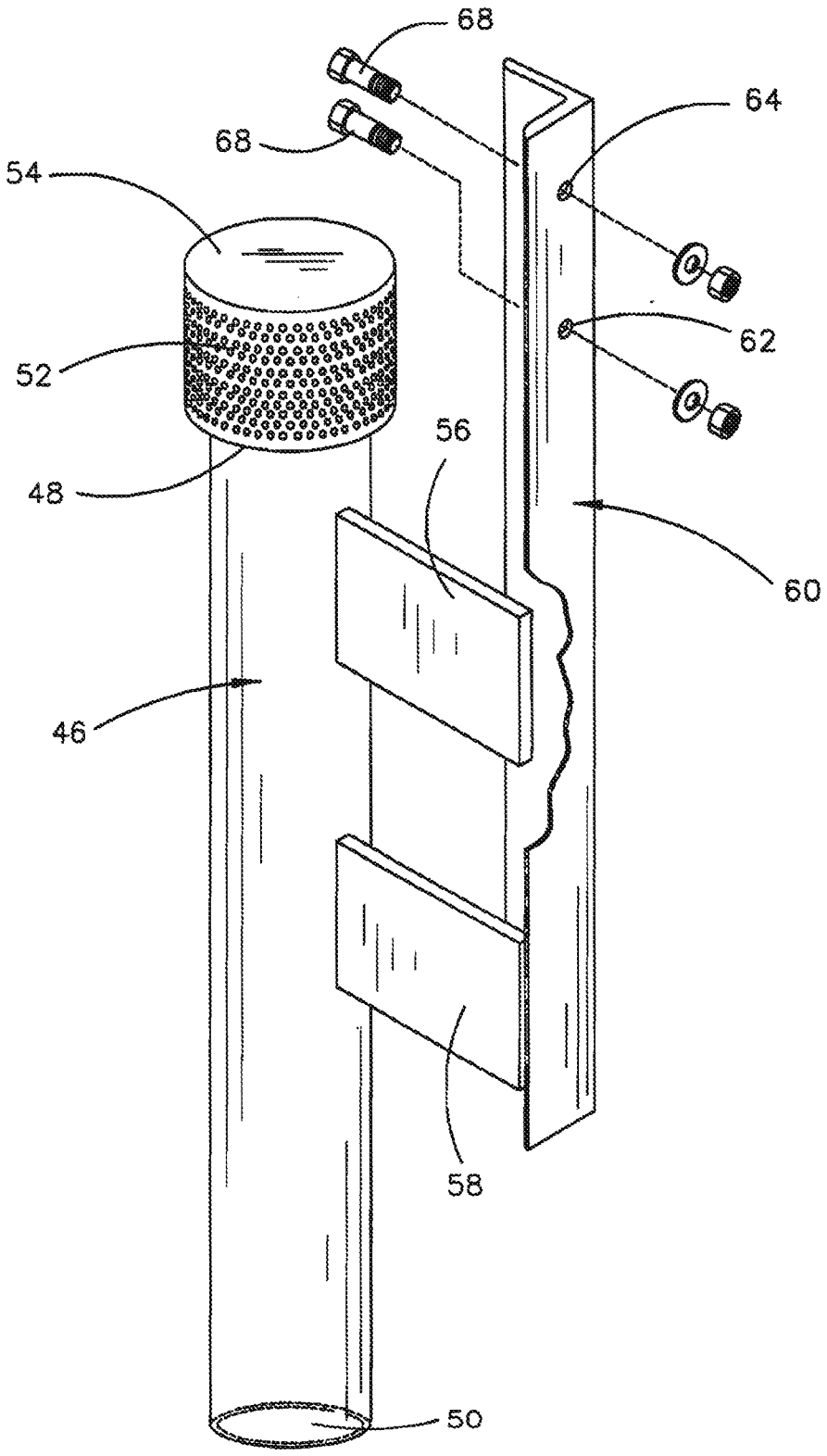
FIG. 3 is an exploded perspective view of the brine overflow tube of the first embodiment of the salt brine production system of this invention.
Figure 4:
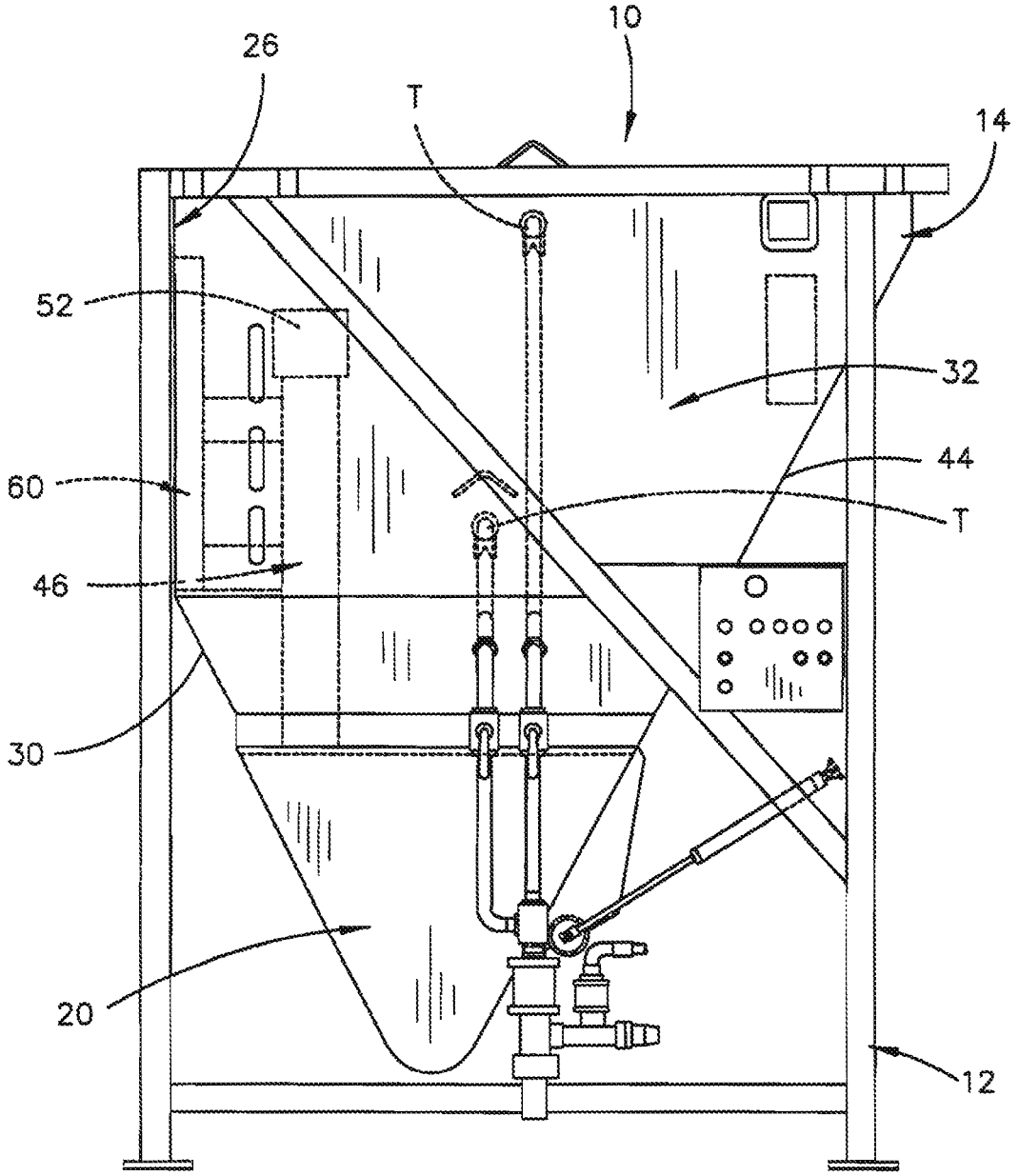
FIG. 4 is an end elevational view of the first embodiment of the salt brine production system of this invention.
Figure 5:
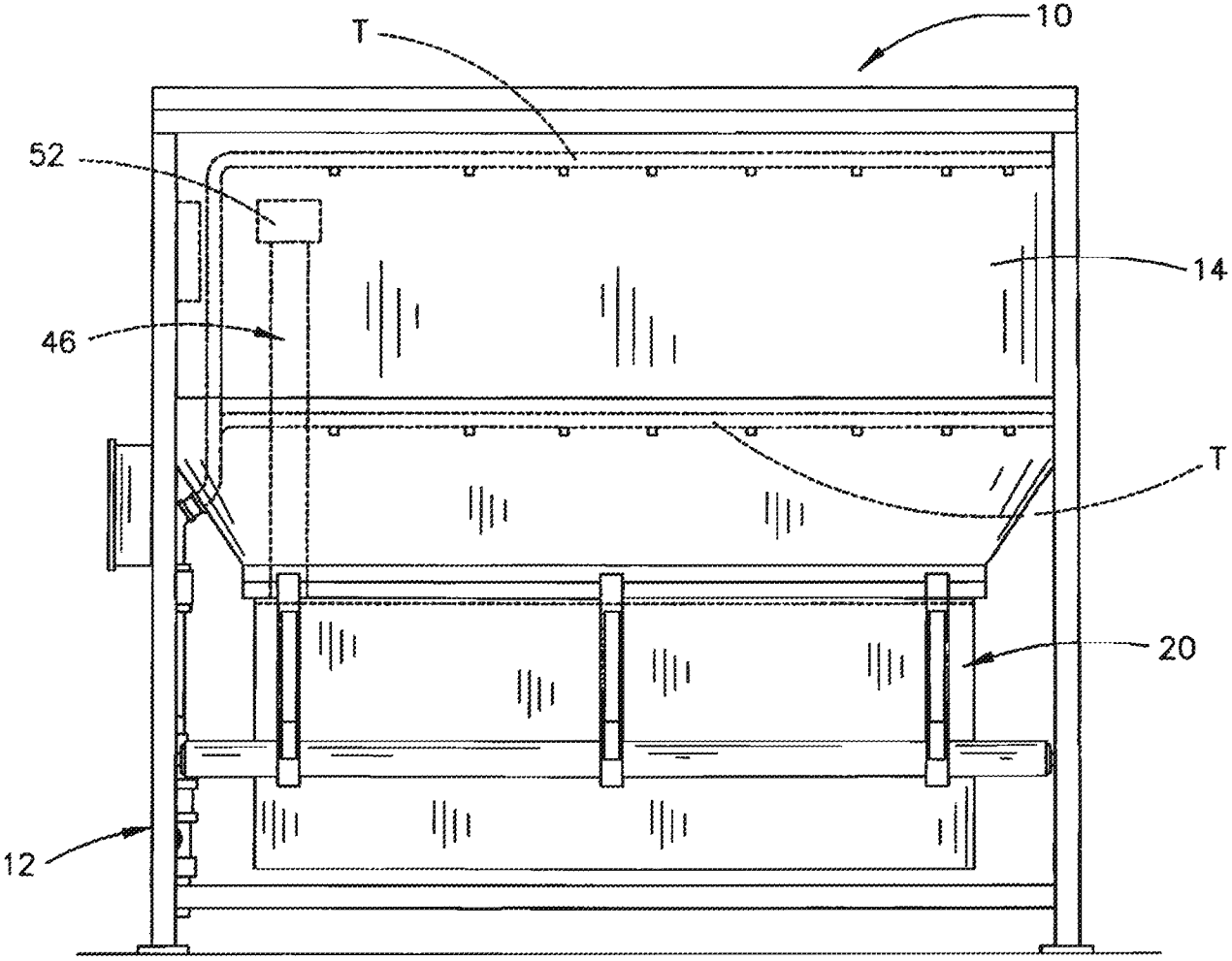
FIG. 5 is a side elevational view of the first embodiment of the salt brine production system of this invention.

FIG. 1 is a perspective view of a prior art salt brine production system (hereinafter "brine maker") such as illustrated in U.S. Pat. No. 7,186,390 which issued on Mar. 6, 2007 and which is owned by Duo Lift Manufacturing Co., inc., the Assignee of the instant invention. U.S. Pat. No. 7,186,390 is incorporated herein by reference thereto to complete this disclosure if necessary. The prior art brine maker 10 of FIG. 1 includes a support frame 12 which has a hopper 14 supported thereon, Hopper 14 includes an open upper end 16 and an open lower end (not shown). A solids screen 18 extends across the lower open end of hopper 14. A receiving tank 20 is pivotally mounted so as to be selectively movable between open and closed ends as described in the '390 patent. A pair of spray bars or tubes (not shown in FIG. 1) are mounted on the hopper 14 so as to supply water to the salt in the hopper 14. The spray bars or tubes T are protected by shields S. The water passes downwardly through the salt to form salt brine which is collected in the receiving tank 20. The salt brine collected in receiving tank 20 is pumped to a storage tank for subsequent use to de-ice, etc., pavement or the like in conventional fashion.

Hopper 14 includes a vertically disposed front wall 26 having an upper end 28 and a tapered lower end 30, Hopper 14 also includes a first end wall 32 having an upper end 34 and a tapered lower end 36. Hopper 14 further includes a second end wall 38 having an upper end 40 and a tapered lower end 42. Hopper 14 also includes an inclined back wall 44. The lower ends of front wall 14, first end wall 32, second end wall 38 and back wall 44 forms an opening which is selectively closed by the pivoting solids screen 18. The solids screen 18 extends over the open upper end of receiving tank 20.

The prior art brine maker 10 of the prior art is a downward flow type of brine production. If the salt in the hopper 14 is of a fine texture, the salt becomes pasty and restricts or slows down the flow of salt brine downwardly therethrough which decreases the productivity of the brine maker 10. The instant invention relates to different approaches to increase the productivity of the brine maker 10 by converting the downward flow brine maker 10 to a downward and upward flow type brine maker 10.

Figure 6:
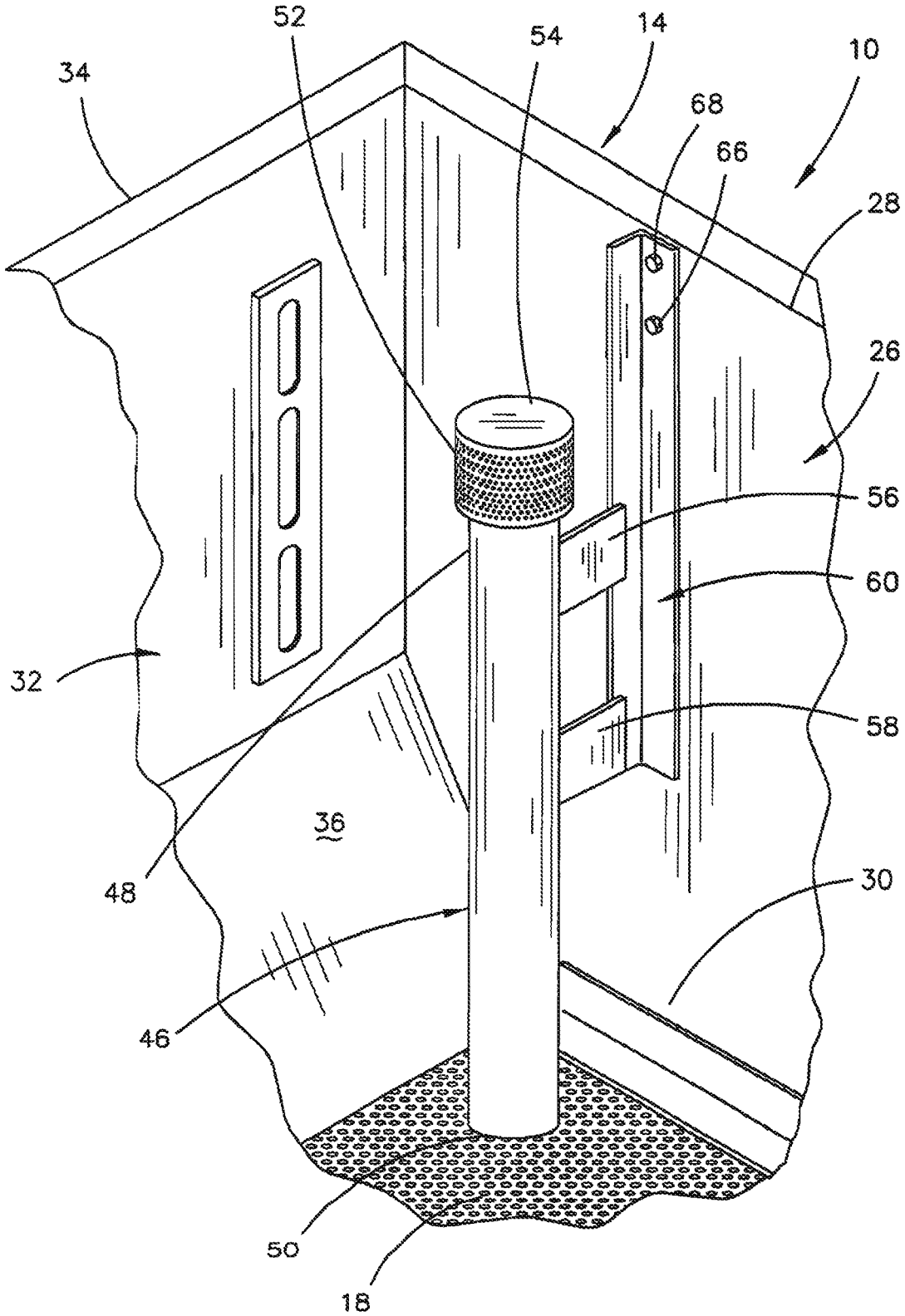
FIG. 6 is a partial perspective view illustrating the brine overflow tube of this invention mounted in the hopper of the salt brine production system.
Figure 7:
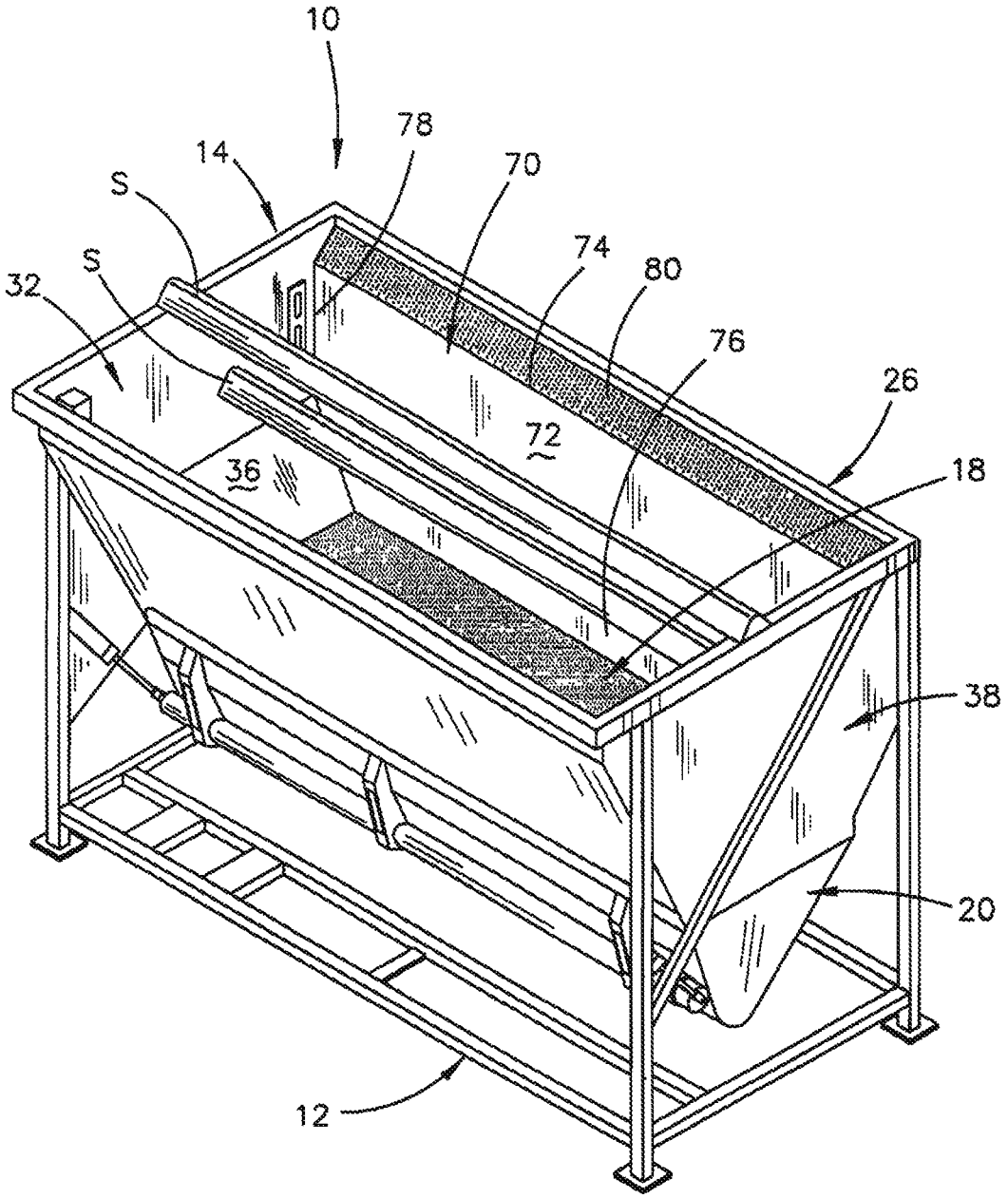
FIG. 7 is a perspective view of the second embodiment of the salt brine production system of this invention.
Figure 8:
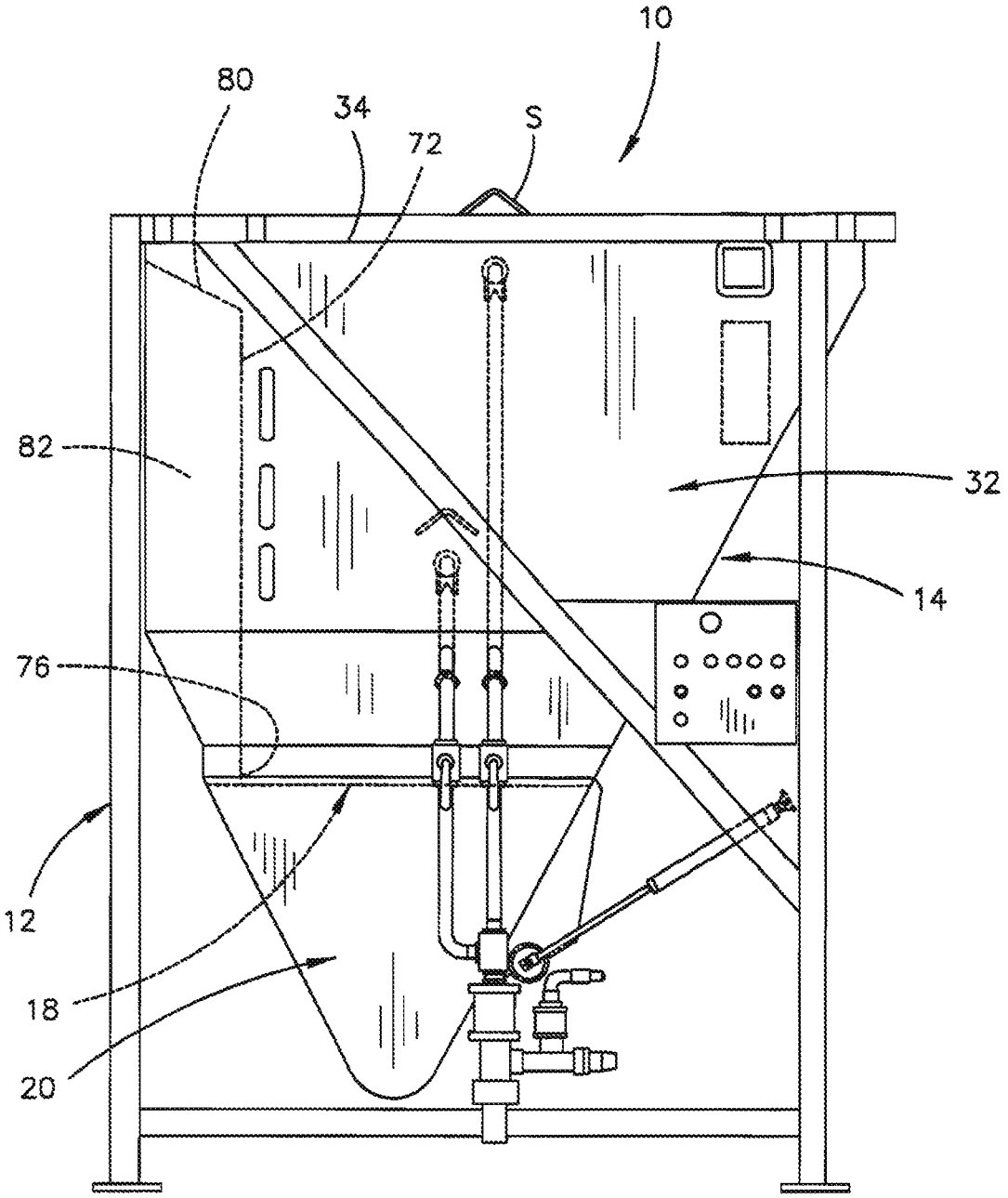
FIG. 8 is an end elevational view of the second embodiment of the salt brine production system of this invention.
Figure 9:
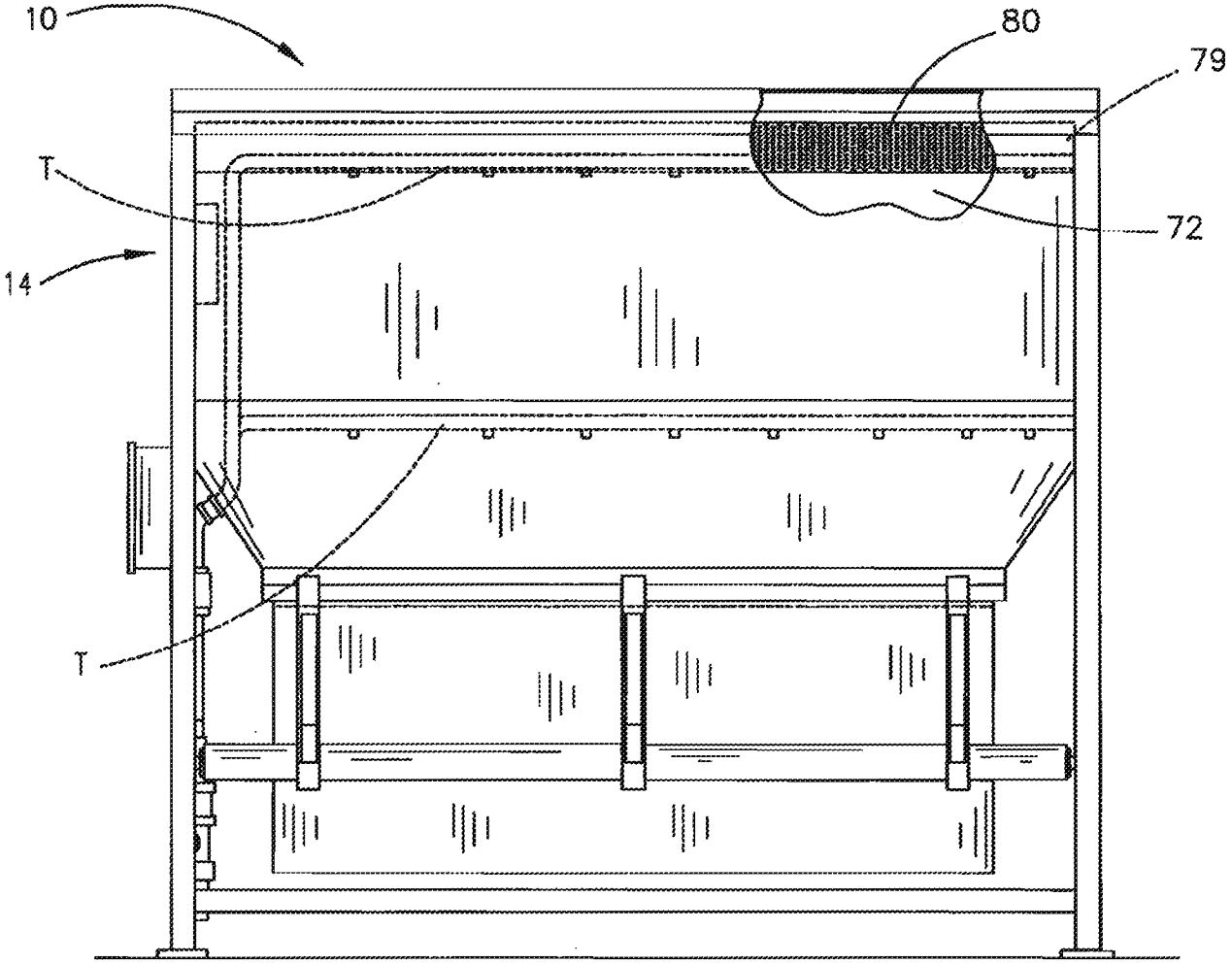
FIG. 9 is a side elevational view of the second embodiment of the salt brine production system of this invention.
Figure 10:
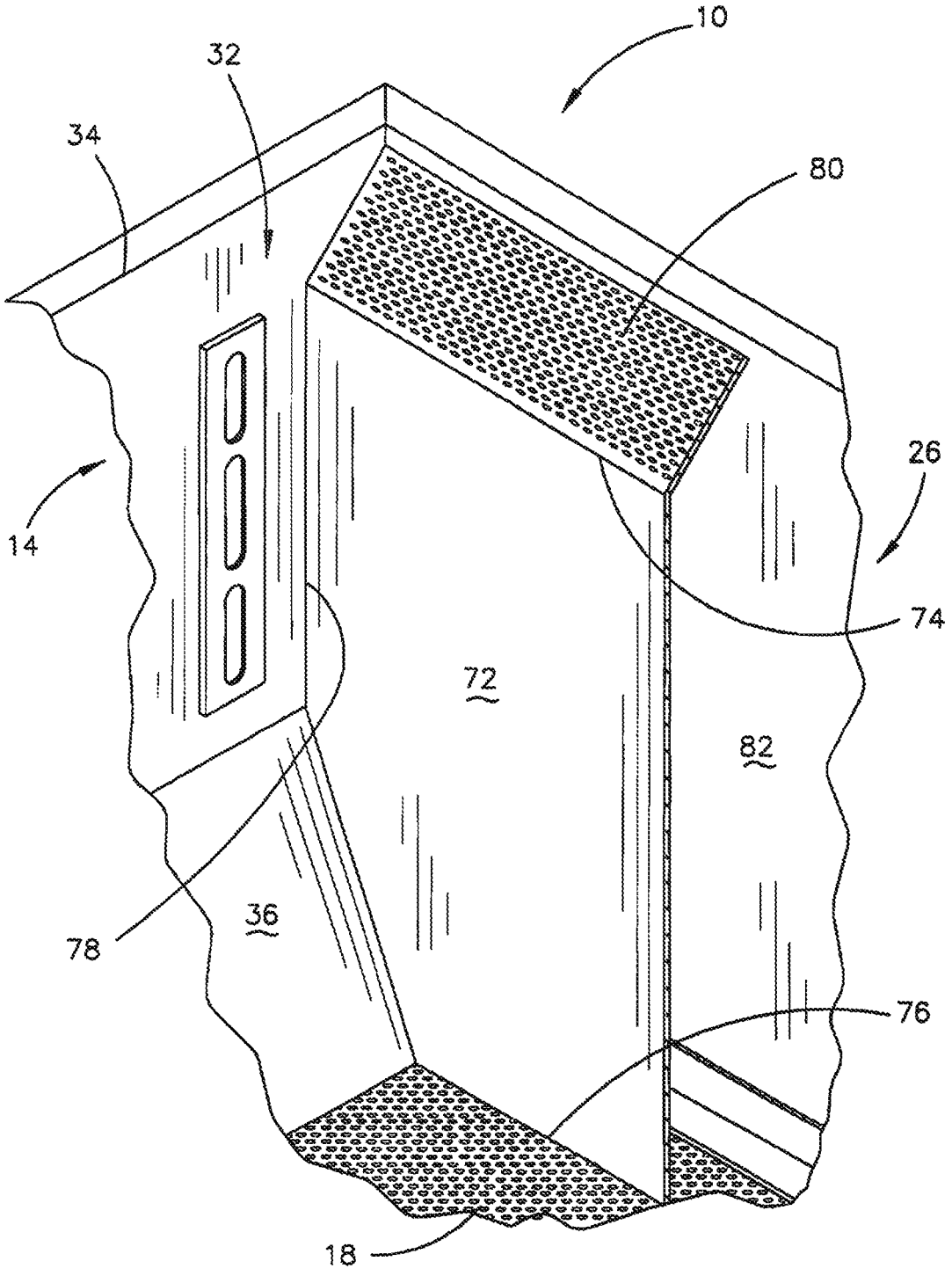
FIG. 10 is a partial perspective view of the second embodiment of the salt brine production system of this invention.

The first embodiment of the invention is illustrated in FIGS. 2-6 as will now be described. The numeral 46 refers to a vertically disposed overflow tube having an open upper end 48 and an open lower end 50. A cylindrical screen 52 is secured to the upper end 48 of overflow tube 46 with the interior of screen 52 being in communication with the open upper end 48 of overflow tube 46. A cover 54 closes the upper end of screen 52. Overflow tube 46 has a pair of mounting brackets 56 and 58 secured thereto by welding or the like and which extend therefrom. The outer ends of brackets 56 and 58 are secured to a vertically disposed angle member 60 by welding or the like. The upper end of angle member 60 has bolt openings 62 and 64 formed therein which are adapted to receive bolts 66 and 68 therein. As seen in FIG. 6, angle member 60 is bolted to the inner surface of front wall 26 of hopper 14 inwardly of end wall 32. As seen in FIG. 6, the screen 52 is positioned below the upper ends of walls 26 and 32. As also seen in FIG. 6, the lower end 50 of overflow tube 46 is positioned on solids screen 18.

During the production of salt brine in the brine maker 10, if the level of brine in hopper 14 reaches the cylindrical screen 52, the salt brine will overflow into the overflow tube 46. The brine passing inwardly into overflow tube 46 will pass downwardly therethrough and through the solids screen 18 into receiving tank 20. Thus, the brine maker 10 becomes a downward flow and internal/upward overflow brine maker.

The numeral 70 refers to the second embodiment of this invention which replaces the overflow tube 46. Assembly 70 includes a wall or panel 72 which has an upper end 74, a lower end 76, and a first end 78, which is tapered so as to conform to the inclined lower end 36 of end wall 32, and a second end 79 which is tapered so as to conform to the inclined lower end of end wall 38. End 78 of wall 72 is welded to end wall 32 so as to be spaced inwardly of wall 26. End 79 of wall 72 is welded to end wall 38 so as to be spaced inwardly of wall 28. As seen, the upper end 74 of wall 72 is positioned inwardly of wall 26 and is positioned below the upper end 28 of wall 26. An elongated and inclined screen 80 is welded or otherwise secured to the upper end 74 of wall 72 so as to extend between the end walls 32 and 38 of hopper 14. As seen, the lower end 76 of wall 72 is positioned on solids screen 18. The wall 72 defines an interior overflow passageway 82, the lower end of which is in communication with the solids screen 18.

During the production of salt brine in the brine maker 10, if the level of brine in hopper 14 reaches screen 80, the salt brine will overflow into the interior overflow passageway 82. The overflow brine will pass from the lower end of passageway 82 onto the solids screen 18 and into the receiving tank 20. Thus, the brine maker 10 becomes a downward flow and internal/upward overflow brine maker.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A salt brine production system, comprising:

a hopper, having an open upper end, an open lower end, a front wall, a back wall, a first end wall and a second end wall;

said front wall, said back wall, said first end wall and said second end wall having inner and outer surfaces;

said hopper being configured to receive salt therein;

a receiving tank having an open upper end;

said receiving tank being positioned below said open lower end of said hopper;

said open lower end of said hopper being in open communication with said open upper end of said receiving tank;

at least one spray device mounted in said hopper which is configured to spray water onto the salt in said hopper;

a solids screen, having upper and lower surfaces, positioned between said open lower end of said hopper and said open upper end of said receiving tank;

a vertically disposed overflow tube having an open upper end and an open lower end;

said overflow tube being positioned in said hopper and being secured thereto;

said open lower end of said overflow tube being in fluid communication with said solids screen;

said upper end of said overflow tube being spaced below said open upper end of said hopper;

a screen mounted on said open upper end of said overflow tube; and said overflow tube being configured to permit the downward flow of salt brine therethrough to said solids screen and said receiving tank when the level of salt brine in said hopper reaches said screen.

2. The salt brine production system of claim 1 wherein said screen of said overflow tube is cylindrical and which has an open lower end and an open upper end with said open upper end of said screen having a cover thereon which closes said open upper end of said screen.

3. The salt brine production system of claim 1 wherein said hopper includes an upstanding front wall, an upstanding back wall, an upstanding first end wall and a second end wall and wherein said overflow tube is positioned inwardly of one of said walls of said hopper.

4. The salt brine production system of claim 3 wherein said overflow tube is positioned in said hopper inwardly of said front wall.

5. The salt brine production system of claim 4 wherein said overflow tube is secured to said front wall.

* * * * *